US006082697A

United States Patent [19]

Grunfeld

[11] Patent Number: 6,082,697

[45] Date of Patent: Jul. 4, 2000

[54] OUTDOOR GOAL ANCHOR DEVICE AND METHOD OF INSTALLING

[76] Inventor: Dan J. Grunfeld, 1360 Bellaire St., Denver, Colo. 80220

[21] Appl. No.: 09/074,738

[22] Filed: May 8, 1998

[51] Int. Cl.[7] ..... A47B 97/00

[52] U.S. Cl. ..... 248/508; 248/156; 248/552; 248/553; 248/50; 52/157

[58] Field of Search ..... 248/508, 545, 248/156, 530, 551, 552, 553; 52/157, 156, 155; 70/58, 234; 211/5; 273/127 B; 473/478

[56] References Cited

U.S. PATENT DOCUMENTS

| | | | |
|---|---|---|---|
| 1,635,923 | 7/1927 | Bray | 52/157 |
| 2,020,158 | 11/1935 | Oakes et al. | 273/127 B |
| 2,573,635 | 10/1951 | Williams | 248/530 X |
| 3,076,532 | 2/1963 | Frye | 52/157 |
| 3,856,265 | 12/1974 | Foster | 52/157 X |
| 3,865,246 | 2/1975 | Lieb et al. | 211/5 |
| 4,009,853 | 3/1977 | Lile | 248/552 X |
| 4,083,561 | 4/1978 | Daffer, Jr. | 473/432 |
| 4,138,806 | 2/1979 | Miller | 52/157 X |
| 5,186,469 | 2/1993 | Terris | 473/478 |
| 5,813,259 | 9/1998 | Martin | 70/58 X |
| 5,855,129 | 1/1999 | Warren et al. | 70/58 X |
| 5,881,978 | 3/1999 | Rust | 248/156 |
| 5,906,077 | 5/1999 | Andiarena | 248/508 X |

FOREIGN PATENT DOCUMENTS

| | | | |
|---|---|---|---|
| 8101926 | 11/1982 | Netherlands | 211/5 |

*Primary Examiner*—Leslie A. Braun
*Assistant Examiner*—Gwendolyn Baxter
*Attorney, Agent, or Firm*—Edwin H. Crabtree; Ramon L. Pizarro; Donald W. Margolis

[57] ABSTRACT

A soccer goal anchor device used for securing a soccer goal in place and a method for installing the anchor device. The anchor device is used for engaging a portion of a soccer goal frame and securing the frame on top of a ground surface. The anchor device can also be used with other types of goals used on a playing field and other outdoor portable equipment. Also, the anchor device prevents the soccer goal frame from pivoting and falling onto a ground surface or the frame from being moved on the ground surface. The anchor device includes an auger for screwing into the ground surface. An upper end of the anchor device includes a clevis. The clevis is dimensioned to conform to different annular and angular cross-sections of goal frames for a snug and secure fit therearound. The clevis includes two upwardly extending flanges for receiving a portion of the soccer goal frame therebetween. The two flanges of the clevis include holes therein for receiving a nut and bolt, locking device or the like to secure the frame inside the clevis. Two or more of the anchor devices can be used for securing the soccer goal frame. The anchor devices are readily adaptable to different sizes of soccer goal frames and can be quickly installed for safety and security on a soccer playing field.

17 Claims, 1 Drawing Sheet

OUTDOOR GOAL ANCHOR DEVICE AND METHOD OF INSTALLING

This application claim the benefit of a U.S. provisional application filed by the subject inventor in the U.S. Patent and Trademark Office on May 12, 1997 and having Ser. No. 60/046,206.

BACKGROUND OF THE INVENTION (a) Field of the Invention

This invention relates to anchor devices and more particularly, but not by way of limitation, to an anchor device for soccer goals and the like. The anchor device is used for engaging and securing a soccer goal frame to a ground surface.

It should be noted that the Federation of International Football Association, (FIFA), an international body which governs all soccer play including U.S. participants at the college, high school and youth divisions, as well as adult and professional players, stresses the importance of safety in their rules related to the anchoring of soccer goals. In the FIFA rules, it states under a heading of Safety, "Goals must be anchored securely to the ground. Portable goals may only be used if they satisfy this requirement."

(b) Discussion of Prior Art

Full size and near full size regulation soccer goals (8 feet high by 24 feet wide) can present a danger if not properly set or anchored into a ground surface. Moreover, portable full size goals, which are designed to accommodate moving about a playing field, are always at risk of falling unless anchored, moored or otherwise attached to the ground. By its structure, a soccer goal's 24 foot long horizontal bar, raised eight feet above the ground, defines a relatively high center of gravity with a potential for pivoting forward and falling on to the ground surface. This is particularly true, when a child or children climb on the soccer goal frame and swing from the raised horizontal bar. This swinging from the horizontal bar has caused the goal frame, when not anchored, to tip forward causing injuries and deaths to children.

Heretofore there have a been a variety of anchor devices using augers for engaging a ground surface. In U.S. Pat. No. 5,011,107 to Reece and U.S. Pat. No. 5,123,623 to McNamara, two different types of anchoring devices are described for securing posts. U.S. Pat. Nos. 4,863,137 to Cockman et al. and 3,848,367 to Barnes describe post anchoring devices with augers for engaging a ground surface. Also, U.S. Pat. No. 4,778,142 to Roba describes an anchoring device.

None of these prior art anchor devices provide a unique combination of structure and features of the subject soccer goal anchor device for engaging and securing a soccer goal frame to a ground surface as described herein.

SUMMARY OF THE INVENTION

In view of the foregoing, it is a primary object of the subject invention to provide a soccer goal anchor device which prevents a soccer goal frame from pivoting and falling forward onto a ground surface which might seriously hurt someone hanging on the goal or standing nearby. Also, the anchor device prevents the frame from being moved on the ground surface.

Another object of the invention is the anchor device can be quickly attached to different sizes of soccer goal frames. Two or more of the soccer goal anchor devices may be attached to the goal frame for securing the frame to the ground surface.

Still another object of the soccer goal anchor device is to provide a means for locking the soccer goal in place on the ground surface and preventing an unauthorized moving of the soccer goal on the playing field.

Yet another object of the invention is the anchor device is well constructed, easy to install in the ground surface and difficult to pull loose from the ground surface. The anchor device can also be used with other types of goals used on playing fields and related portable equipment.

The subject anchor device includes an auger for screwing into the ground surface. An upper end of the anchor device includes a clevis. The clevis is dimensioned to conform to different annular and angular cross-sections of goal frames for a secure fit therearound. The clevis includes two upwardly extending flanges for receiving a portion of the soccer goal frame therebetween. The two flanges of the clevis include holes therein for receiving a nut and bolt, locking device or the like to secure the frame inside the clevis. Two or more of the anchor devices can be used for securing the soccer goal frame. The anchor devices are readily adaptable to different sizes of soccer goal frames and can be quickly installed for safety and security on a soccer playing field.

These and other objects of the present invention will become apparent to those familiar with the sport of soccer, soccer goals and anchoring systems when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
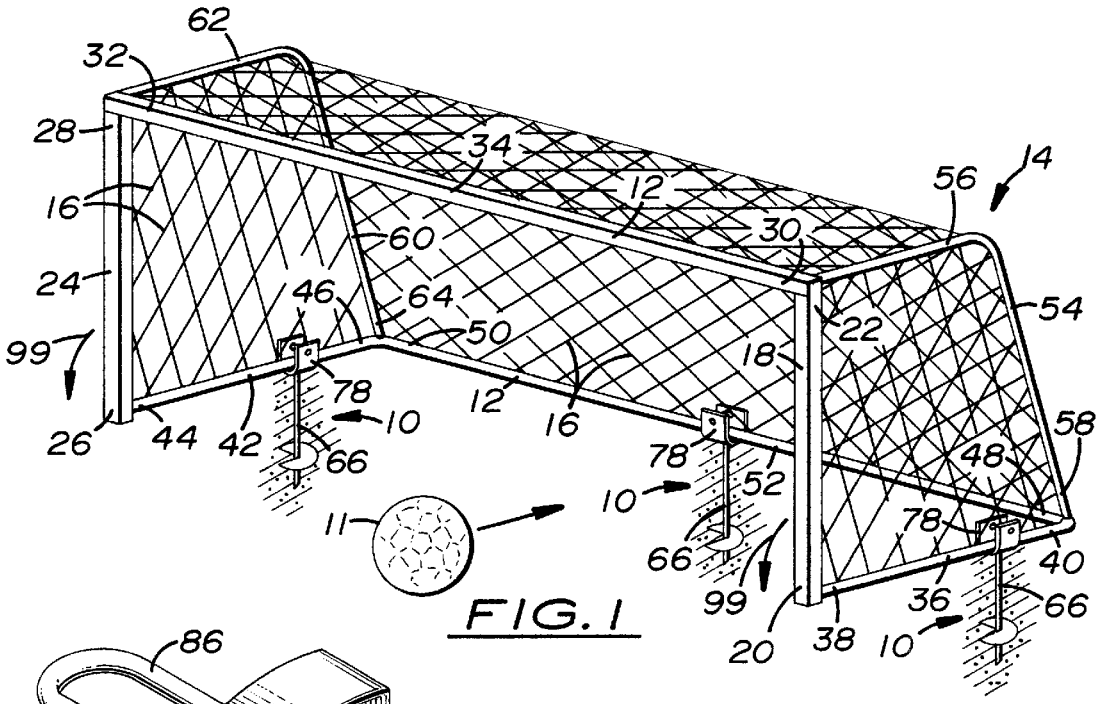
FIG. 1 is a perspective view of a typical soccer goal with three of the soccer goal anchor devices used for securing a ground engaging portion of a soccer goal frame to the top of a ground surface.

In FIG. 1, the subject soccer goal anchor device is shown having a general reference numeral 10. In this drawing, three of the anchor devices 10 are shown secured to a soccer goal frame 12 of a soccer goal. The soccer goal is shown having a general reference numeral 14. The soccer goal 14 includes netting 16 attached to the frame 12. The subject anchor device 10 is used with a lower portion or ground engaging portion of the frame 12 described herein.

A typical regulation full-size soccer goal frame is 8 feet high and 24 feet wide. The soccer goal anchor device 10 may be used with other sizes of soccer goals equally well and other types of outdoor goals used on a playing field and related portable equipment. A front of the frame 12, shown receiving a soccer ball 11 therethrough, includes a first vertical post 18 having a lower end 20 and an upper end 22 and a second vertical post 24 having a lower end 26 and an upper end 28. The upper end 22 of the first vertical post 18 and the upper end 28 of the second vertical post 24 are attached to opposite ends 30 and 32 of an upper horizontal bar 34.

Extending rearwardly from the front of the frame 12 is a ground engaging first side bar 36 having a front end 38 and a rear end 40. The front end 38 of the first side bar 36 is attached to the lower end 20 of the first vertical post 18. A ground engaging second side bar 42 includes a front end 44 and a rear end 46. The front end 44 of the second side bar 42 is attached to the lower end 26 of the second vertical post 24. The rear end 40 of the first side bar 36 and the rear end 46 of the second side bar 42 are attached to opposite ends 48 and 50 of an optional ground engaging rear bar 52.

The rear bar 52 and the two side bars 36 and 42 of the frame 12 are used as goal stabilizing members and as skids when moving the soccer goal 14 to various locations on a playing field. Also, the rear bar 52 and the first and second side bars 36 and 42 are used for receipt of the soccer goal anchor devices 10 and securing the soccer goal 14 in place.

The soccer goal frame 12 further includes a first angle brace 54 having an upper end 56 and a lower end 58. The upper end 56 is attached to the upper end 22 of the first vertical post 18. The lower end 58 of the brace 54 is attached to the end 48 of the rear bar 52. A second angle brace 60 includes an upper end 62 and a lower end 64. The upper end 62 is attached to the upper end 28 of the second vertical post 24. The lower end 64 of the brace 60 is attached to the end 50 of the rear bar 52.

Figure 2:
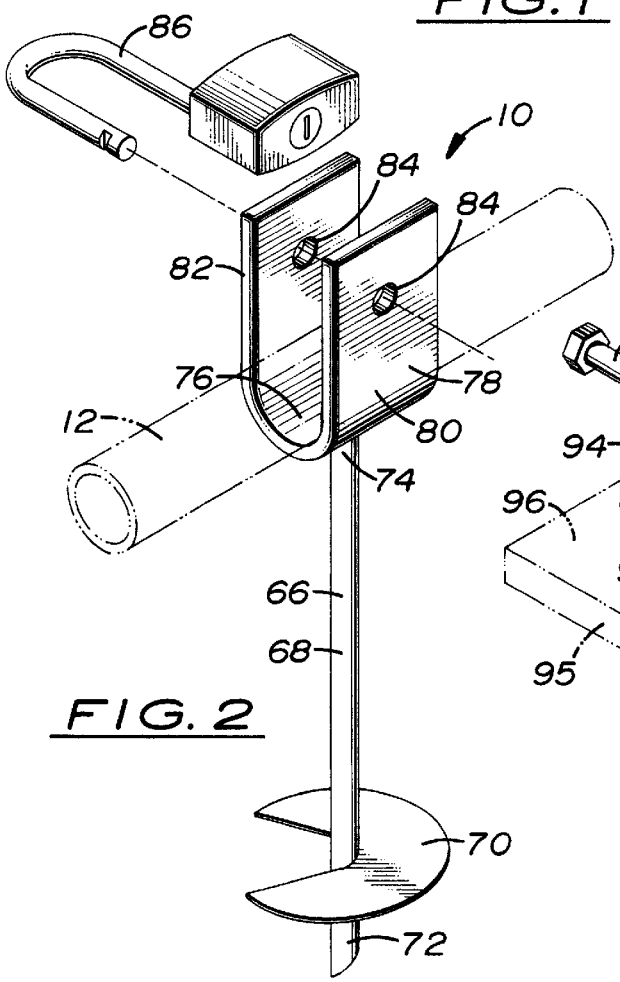
FIG. 2 is an enlarged perspective view of the soccer goal anchor device including an auger and a clevis with flanges for receiving a padlock through holes in the flanges. The clevis is designed for engaging a bottom of a goal frame having a annular tube or pipe shaped cross-section.

In FIG. 2, an enlarged perspective view of the soccer goal anchor device 10 is illustrated. The device 10 includes an auger 66 with auger shaft 68 and a helix 70 mounted on a lower end 72 of the shaft 68. An upper end 74 of the shaft 68 is mounted to a semi-circular bottom portion 76 of a "U" shaped clevis 78. The clevis 78 includes a pair of parallel upwardly extending flanges 80 and 82 extending upwardly from the bottom portion 76. The top of the flanges 80 and 82 include holes 84 therein for receiving a portion of a padlock 86 through the holes 84 for securing the frame 12 inside the clevis 78. It should be noted that "U" shaped clevis 78 is dimensioned for receiving the cross-section of the lower ground engaging portions such as first and second side bars 36 and 42 and rear bar 52 of the goal frame 12. In this example, the goal frame 12, shown in dotted lines, has an annular tube or pipe cross-section in a range of 1 to 3 inches in diameter with the flanges 80 and 82 spaced apart for receiving a portion of the goal frame 12 therebetween. In this example, the goal frame 12 may take on various types of annular cross-sectional configurations with the semi-circular bottom portion 76 and the flanges 80 and 82 of the clevis 78 designed to engage and wrap around the goal frame 12 in a snug fit and holding a portion of the goal frame 12 therein.

Figure 3:
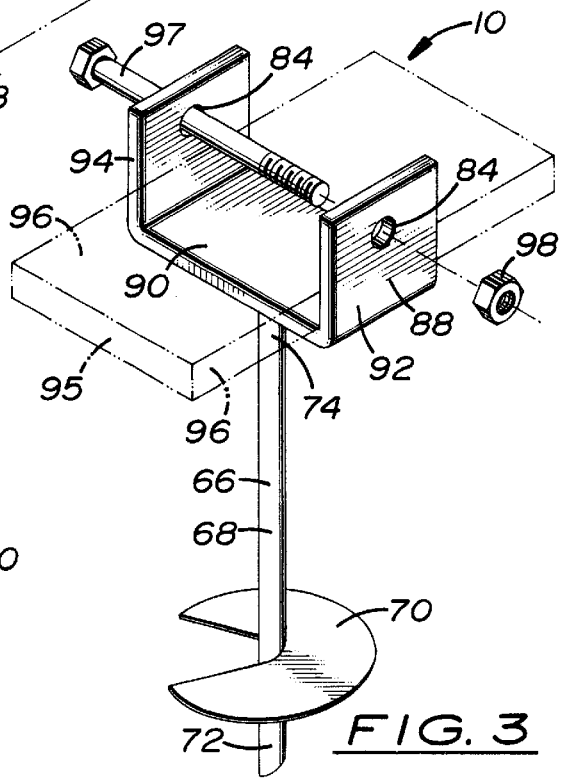
FIG. 3 is an enlarged perspective view of the soccer goal anchor device including an auger and a clevis with flanges for receiving a bolt through holes in the flanges. The clevis is designed for engaging a bottom of a goal frame having a flat cross-section.

In FIG. 3, an enlarged perspective view of the soccer goal anchor device 10 is shown and similar to FIG. 2. In this drawing, the anchor device 10 is shown with an enlarged angular shaped clevis 88 with a flat horizontal base 90 and upwardly extending flanges 92 and 94. The clevis 88 is designed for engaging a goal frame 12, shown in dotted lines, having a flat angular plate 96. The base 90 may be in a range of 2 is 4 inches in width and the two flanges 92 and 94 are 1 to 4 inches in height. The clevis 88 is shown with the flanges 92 and 94 having holes 84 for receiving a bolt 97 therethrough and fastened to a nut 98 for holding the goal frame 12 therein. In this design, the clevis 88 is obviously designed for receiving a goal frame 12 having an flat, rectangular or square cross-section. The flat base 90 and the flanges 92 and 94 providing a snug and secured fit when engaging the sides of the goal frame 12 as shown in FIG. 3.

While the bolt 97 and nut 98 are shown in this drawing, it can be appreciated that other types of fasteners can be used equally well with the clevis 78 and clevis 88 shown in the drawings for securing the goal frame 12 thereto.

In the operation of installing the anchor devices 10 to the soccer goal frame 12, a suitable site is located on the ground surface of a playing field. A steel rod, handle or large screw driver is inserted through the holes 84 in the clevis 78 or holes 84 in the clevis 88 and downward pressure is applied to the auger 66. At this time, the helix 70 is screwed into the ground by rotating the auger shaft 68 until the bottom of the clevis rests on top of the ground surface. The steel rod, handle or large screw driver is then removed from the holes 88. The flanges of the clevis are then positioned for receiving a portion of, for example, the first side bar 36 of the goal frame 12. After the side bar 36 is received between the flanges, a locking device such as the bolt 97 and nut 92 or lock 86 are used to secure the first side bar 36 to the anchor device 10. The steps described above are now repeated for addition anchor devices 10 for engaging the second side bar 42 and/or the rear bar 52.

For a proper installation and making sure the soccer goal frame 12 is secured to the ground surface, it is recommended that at least two of the anchor devices 10 (called a two point application) be attached to the rear of the first and second side bars 36 and 42. For added safety, a third anchor device 10 can be added (called a three point application) at a midportion of the rear bar 52. Also additional anchor devices 10 may be added for further safety. It should be noted, that if an unanchored soccer goal frame 12 falls forward by someone swinging on the upper horizontal bar 34, the frame 12 will pivot about a point at the lower end 20 of the first vertical post 18 and the lower end 26 of the second vertical post 24. To prevent the pivoting of the frame 12, as indicated by arrows 99 shown in FIG. 1, the anchor devices 10 are secured at the rear of the first and second side bars 36 and 42 and thereby providing a greater moment to prevent the pivoting of the frame 12 forward and falling. The addition of an anchor device 10 attached to the rear bar 52 provides further protection.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

What is claimed is:

1. A two point soccer goal safety method of securing a portable and moveable soccer goal frame to a ground surface and protecting an individual when swinging on the frame, the safety method using first and second soccer goal anchor devices, the anchor devices having a clevis mounted on top of an auger, the soccer goal frame having a first vertical post, a second vertical post, an upper horizontal bar attached at opposite ends to upper ends of the vertical posts, ground engaging first and second side bars, a front end of the side bars attached to lower ends of the vertical posts and a rear end of the side bars attached to opposite ends of a ground engaging rear bar, the steps comprising:

screwing the auger of the first anchor device into the ground surface next to the rear end of the first side bar until a bottom of the clevis engages the top of the ground surface;

placing a portion of a rear of the first side bar inside the clevis of the first anchor device;

securing the portion of the rear of the first side bar inside the clevis;

screwing the auger of the second anchor device into the ground surface next to the rear end of the second side bar until a bottom of the clevis engages the top of the ground surface;

placing a portion of a rear of the second side bar inside the clevis of the second anchor device; and securing the portion of the rear of the second side bar inside the clevis;

whereby the securing of the first and second anchor devices to the soccer goal frame at the rear of the first and second side bars provides a greater moment to prevent the pivoting of the soccer goal frame forward and falling onto the ground surface when the individual swings on the upper horizontal bar and the soccer goal frame falling forward from wind gusts.

2. The method as described in claim 1 wherein the first side bar is secured inside the clevis using a first removable locking device.

3. The method as described in claim 2 wherein said first removable locking device is a first threaded bolt with a nut received thereon.

4. The method as described in claim 2 wherein said first removable locking device is a first padlock.

5. The method as described in claim 1 wherein the second side bar is secured inside the clevis using a second removable locking device.

6. The method as described in claim 5 wherein said second removable locking device is a second threaded bolt with a nut received thereon.

7. The method as described in claim 5 wherein said second removable locking device is a second padlock.

8. A two point soccer goal safety method of securing a portable and moveable soccer goal frame to a ground surface and protecting an individual when swinging on the frame, the safety method using first and second soccer goal anchor devices, the anchor devices having a clevis mounted on top of an auger, the soccer goal frame having a first vertical post, a second vertical post, an upper horizontal bar attached at opposite ends to upper ends of the vertical posts, ground engaging first and second side bars, a front end of the side bars attached to lower ends of the vertical posts and a rear end of the side bars attached to opposite ends of a ground engaging rear bar, the steps comprising:

screwing the auger of the first anchor device into the ground surface next to the rear end of the first side bar until a bottom of the clevis engages the top of the ground surface;

placing a portion of a rear of the first side bar inside the clevis of the first anchor device;

securing the portion of the rear of the first side bar inside the clevis with a first removable locking device;

screwing the auger of the second anchor device into the ground surface next to the rear end of the second side bar until a bottom of the clevis engages the top of the ground surface;

placing a portion of a rear of the second side bar inside the clevis of the second anchor device; and securing the portion of the rear of the second side bar inside the clevis with a second removable locking device;

whereby the securing of the first and second anchor devices to the soccer goal frame at the rear of the first and second side bars provide a greater moment to prevent the pivoting of the soccer goal frame forward and falling onto the ground surface when the individual swings on the upper horizontal bar and the soccer goal frame falling forward from wind gusts.

9. The method as described in claim 8 wherein said first removable locking device is a first threaded bolt with a nut received thereon.

10. The method as described in claim 8 wherein said first removable locking device is a first padlock.

11. The method as described in claim 8 wherein said second removable locking device is a second threaded bolt with a nut received thereon.

12. The method as described in claim 8 wherein said second removable locking device is a second padlock.

13. A three point soccer goal safety method of securing a portable and moveable soccer goal frame to a ground surface and protecting an individual when swinging on the frame, the safety method using first, second and third soccer goal anchor devices, the anchor devices having a clevis mounted on top of an auger, the soccer goal frame having a first vertical post, a second vertical post, an upper horizontal bar attached at opposite ends to upper ends of the vertical posts, ground engaging first and second side bars, a front end of the side bars attached to lower ends of the vertical posts and a rear end of the side bars attached to opposite ends of a ground engaging rear bar, the steps comprising:

screwing the auger of the first anchor device into the ground surface next to the rear end of the first side bar until a bottom of the clevis engages the top of the ground surface;

placing a portion of a rear of the first side bar inside the clevis of the first anchor device;

securing the portion of the rear of the first side bar inside the clevis;

screwing the auger of the second anchor device into the ground surface next to the rear end of the second side bar until a bottom of the clevis engages the top of the ground surface;

placing a portion of a rear of the second side bar inside the clevis of the second anchor device; and securing the portion of the rear of the second side bar inside the clevis;

screwing the auger of the third anchor device into the ground surface next to the rear bar until a bottom of the clevis engages the top of the ground surface;

placing a portion of rear bar inside the clevis of the third anchor device; and securing the portion of the rear bar inside the clevis;

whereby the securing of the first, second and third anchor devices to the soccer goal frame at the rear of the first and second side bars and the rear bar provide a greater moment to prevent the pivoting of the soccer goal frame forward and falling onto the ground surface when the individual swings on the upper horizontal bar and the soccer goal frame falling forward from wind gusts.

14. The method as described in claim 13 wherein the first side bar is secured inside the clevis of the first anchor device using a first removable locking device, the second side bar is secured inside the clevis of the second anchor device using a second removable locking device and the rear bar is secured inside the clevis of the third anchor device using a third removable locking device.

15. The method as described in claim 14 wherein said first removable locking device is a first threaded bolt with a nut received thereon said second removable locking device is a second threaded bolt with nut and said third removable locking device is a third threaded bolt with nut.

16. The method as described in claim 14 wherein said first removable locking device is a first padlock received thereon, said second removable locking device is a second padlock and said third removable locking device is a third padlock.

17. The method as described in claim 13 wherein the portion of the rear bar placed inside the clevis of the third anchor device is a center portion of the rear bar.

* * * * *